US011185748B2

(12) United States Patent
Couroux

(10) Patent No.: US 11,185,748 B2
(45) Date of Patent: Nov. 30, 2021

(54) GOLF BALL RETRIEVING DEVICE

(71) Applicant: Allen Couroux, Dartmouth (CA)

(72) Inventor: Allen Couroux, Dartmouth (CA)

( * ) Notice: Subject to any disclaimer, the term of this patent is extended or adjusted under 35 U.S.C. 154(b) by 0 days.

(21) Appl. No.: 16/817,753

(22) Filed: Mar. 13, 2020

(65) Prior Publication Data

US 2021/0197042 A1 Jul. 1, 2021

(30) Foreign Application Priority Data

Dec. 30, 2019 (CA) ..... CA 3066267

(51) Int. Cl.
*A63B 57/00* (2015.01)
*A63B 57/40* (2015.01)

(52) U.S. Cl.
CPC ..... *A63B 57/40* (2015.10)

(58) Field of Classification Search
CPC .. A63B 57/40; A63B 57/357; A63B 2225/093
USPC ..... 473/173–179
See application file for complete search history.

(56) References Cited

U.S. PATENT DOCUMENTS 1,829,283 A * 10/1931 Kip ..... A63B 57/40 473/177
2,684,245 A * 7/1954 Jacoby ..... A63B 57/357 473/176
3,310,026 A * 3/1967 Baird, Jr. ..... A63B 57/40 116/173
5,451,045 A * 9/1995 Garske ..... A63B 57/357 473/176
6,939,239 B1 * 9/2005 Ash ..... A63B 57/357 473/176
7,431,658 B2 * 10/2008 Priegel ..... A63B 57/40 473/175
7,959,516 B2 * 6/2011 Hansen ..... A63B 57/40 473/176
10,471,316 B1 * 11/2019 Bartlett ..... A63B 47/02
10,500,456 B1 * 12/2019 Cardone ..... A63B 47/02
2003/0157989 A1 * 8/2003 Porter ..... A63B 57/40 473/173
2009/0280919 A1 * 11/2009 Prince ..... G09F 23/0066 473/176
2018/0207496 A1 * 7/2018 Zeidan ..... G09F 23/0066
2020/0330837 A1 * 10/2020 Manley ..... A63B 57/357

OTHER PUBLICATIONS

"Par AIDE Edge Saver", https://www.youtube.com/watch?v=TPcwFwp2Evo, Published Nov. 25, 2019 ((Downloaded on May 13, 2021).

* cited by examiner

*Primary Examiner* — Nini F Legesse
(74) *Attorney, Agent, or Firm* — Bonini IP Law, LLC; Frank J. Bonini, Jr.

(57) ABSTRACT

A golf ball retrieving device is provided. The golf ball retrieving device comprises a golf ball holding structure which is adapted for being placed between a bottom portion of a golf flagstick and an inside wall of a golf cup. The golf ball holding structure retains a golf ball after being putted into the golf cup. An interacting structure secures the golf ball holding structure to the bottom portion of the golf flagstick.

12 Claims, 7 Drawing Sheets

GOLF BALL RETRIEVING DEVICE

FIELD OF THE INVENTION

The present invention relates to golf cups and golf flagsticks, and more particularly to a device fitted to the end of the golf flagstick for retrieving a golf ball from the golf cup.

BACKGROUND OF THE INVENTION

In recent years, golf is enjoying an ever increasing popularity all over the world. In particular, the popularity of golf is increasing with the age of the players, providing physical outdoor activity that is less strenuous than most other outdoor sport activities. The goal of playing golf is to strike the golf ball with a golf club in order to propel it from the teeing ground towards the putting green and finally into a golf cup disposed in the ground of the putting green. Typically, the winner is the player that needed the lowest number of strokes. Golf rules changes implemented in January 2019 by the governing body of golf, the USGA, have allowed players to putt out with the golf flagstick left in the golf cup.

Unfortunately, after putting out, the golf ball has to be retrieved from the golf cup requiring bending down or kneeling in order to reach the golf ball disposed in the golf cup below the level of the ground level of the putting green which can pose a substantial physical challenge for older players. For example, a player uses his/her golf club for support during bending down and getting up after retrieving the golf ball, potentially damaging the putting green. Alternatively, some players use the flagstick to retrieve the golf ball from the golf cup, potentially damaging the ferrule, the golf cup, and/or damaging the putting surface above the golf cup.

A golf cup typically comprises a cylinder with a central bore at a bottom end portion thereof for receiving a ferrule mounted to a bottom end of a golf flagstick. Unfortunately, leaves are able to accumulate at the base of the golf cup and ultimately, after removal of the golf flagstick, enter the central bore where it becomes meshed between the ferrule and the central bore when the golf flagstick is inserted again.

It is desirable to provide a golf ball retrieving device for facilitating retrieval of a golf ball from a golf cup.

It is also desirable to provide a golf ball retrieving device that is easily secured to a bottom portion of a golf flagstick.

It is also desirable to provide a golf ball retrieving device that substantially helps to limit damage to the turf area surrounding the golf hole.

It is also desirable to provide a device that substantially prevents leaves from entering the central bore of the golf cup.

SUMMARY OF THE INVENTION

Accordingly, one object of the present invention is to provide a golf ball retrieving device for facilitating retrieval of a golf ball from a golf cup.

Another object of the present invention is to provide a golf ball retrieving device that is easily secured to a bottom portion of a golf flagstick.

Another object of the present invention is to provide a golf ball retrieving device that substantially helps to limit damage to the turf area surrounding the golf hole.

Another object of the present invention is to provide a device that substantially prevents leaves from entering the central bore of the golf cup.

According to one aspect of the present invention, there is provided a golf ball retrieving device. The golf ball retrieving device comprises a golf ball holding structure which is adapted for being placed on the bottom portion of a golf flagstick and an inside wall of a golf cup. The golf ball holding structure retains a golf ball after being putted into the golf cup. An interacting structure secures the golf ball holding structure to the bottom portion of the golf flagstick.

According to the aspect of the present invention, there is provided a golf ball retrieving device. The golf ball retrieving device comprises a golf ball holding structure which is adapted for being placed between a bottom portion of a golf flagstick and an inside wall of a golf cup. The golf ball holding structure retains a golf ball after being putted into the golf cup. The golf ball holding structure is a trough adapted for surrounding the bottom portion of the golf flagstick. The trough has an inside rim for surrounding the bottom portion of the golf flagstick in close proximity thereto and an outside rim adapted for surrounding the bottom portion of the golf flagstick at a predetermined distance such that the trough is capable of accommodating a bottom portion of a golf ball therein. An interacting structure secures the golf ball holding structure to the bottom portion of the golf flagstick.

According to the aspect of the present invention, there is provided a method for retrieving a golf ball from a golf cup. A golf ball retrieving device as hereinabove is provided. The golf ball retrieving device is secured to a bottom portion of a golf flagstick. The bottom portion of the golf flagstick with the golf ball retrieving device is placed into a respective bore of a golf cup. A golf ball is putted into the golf cup. The golf flagstick with the golf ball retrieving device is then lifted upwardly from the golf cup and the golf ball is removed from the golf ball retrieving device.

According to the aspect of the present invention, there is provided a method for retrieving a golf ball from a golf cup. A golf ball retrieving device as hereinabove is provided. The golf ball retrieving device is secured to a bottom portion of a golf flagstick by sliding the golf ball retrieving device along the golf flagstick until the same is in contact with a ferrule mounted to the bottom portion of the golf flagstick. The bottom portion of the golf flagstick with the golf ball retrieving device is placed into a respective bore of a golf cup. A golf ball is putted into the golf cup. The golf flagstick with the golf ball retrieving device is then lifted upwardly from the golf cup and the golf ball is removed from the golf ball retrieving device.

The advantage of the present invention is that it provides a golf ball retrieving device for facilitating retrieval of a golf ball from a golf cup.

A further advantage of the present invention is that it provides a golf ball retrieving device that is easily secured to a bottom portion of a golf flagstick.

A further advantage of the present invention is that it provides a golf ball retrieving device that substantially helps to limit damage to the turf area surrounding the golf hole.

A further advantage of the present invention is that it provides a device that substantially prevents leaves from entering the central bore of the golf cup.

BRIEF DESCRIPTION OF THE DRAWINGS

A preferred embodiment of the present invention is described below with reference to the accompanying drawings, in which.

DESCRIPTION OF THE PREFERRED EMBODIMENT

Unless defined otherwise, all technical and scientific terms used herein have the same meaning as commonly understood by one of ordinary skill in the art to which the invention belongs. Although any methods and materials similar or equivalent to those described herein can be used in the practice or testing of the present invention, the preferred methods and materials are now described.

Figure 1:
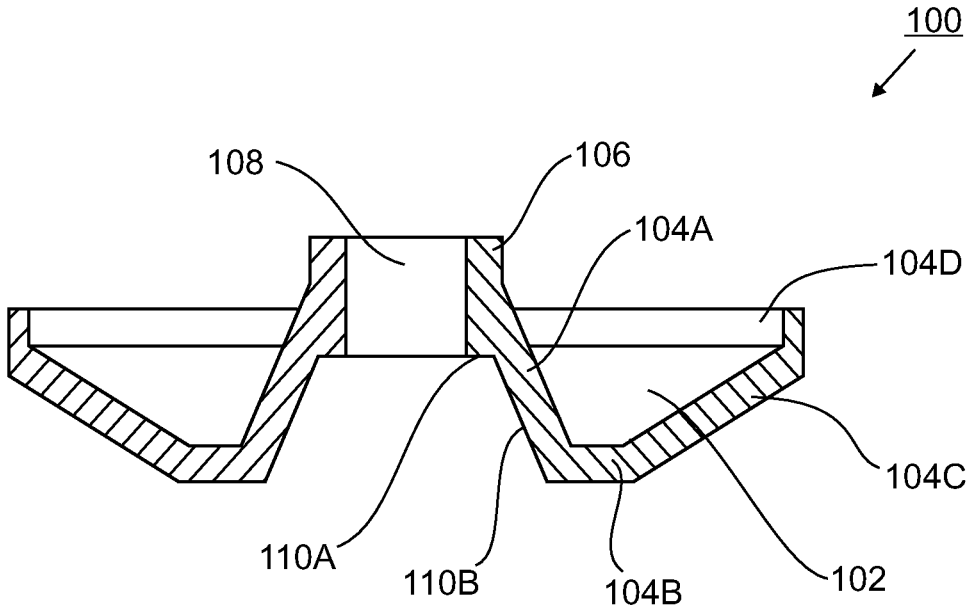
FIGS. 1 and 2 are simplified block diagrams illustrating in a cross-sectional view and a top view, respectively, a golf ball retrieving device according to a preferred embodiment of the invention.
Figure 2:
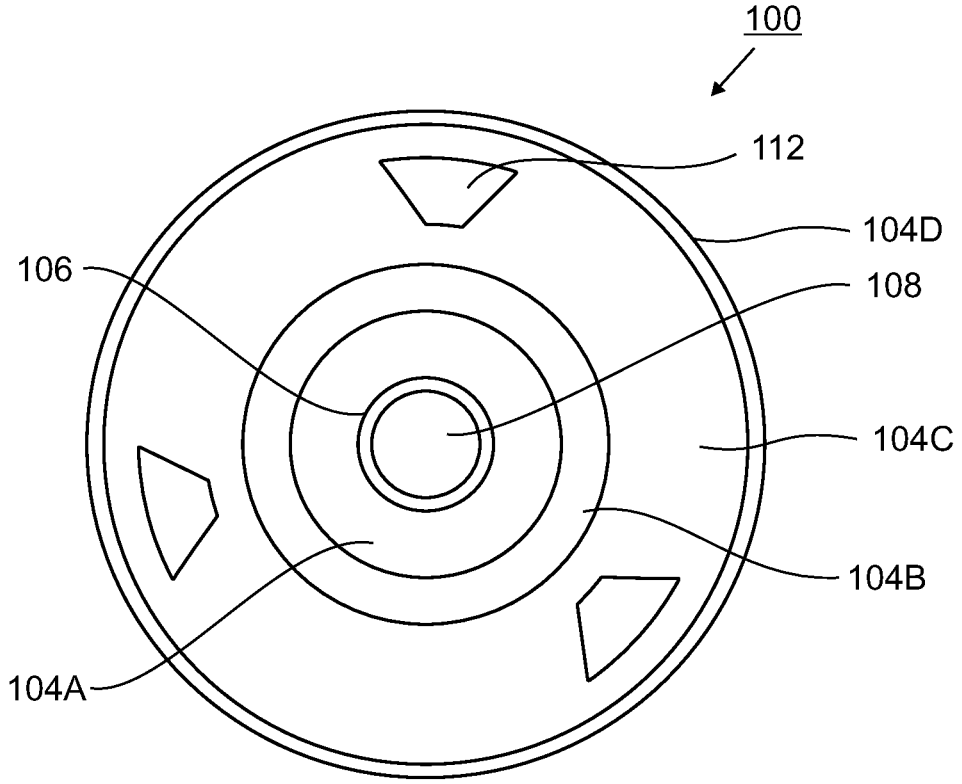
Figure 3:
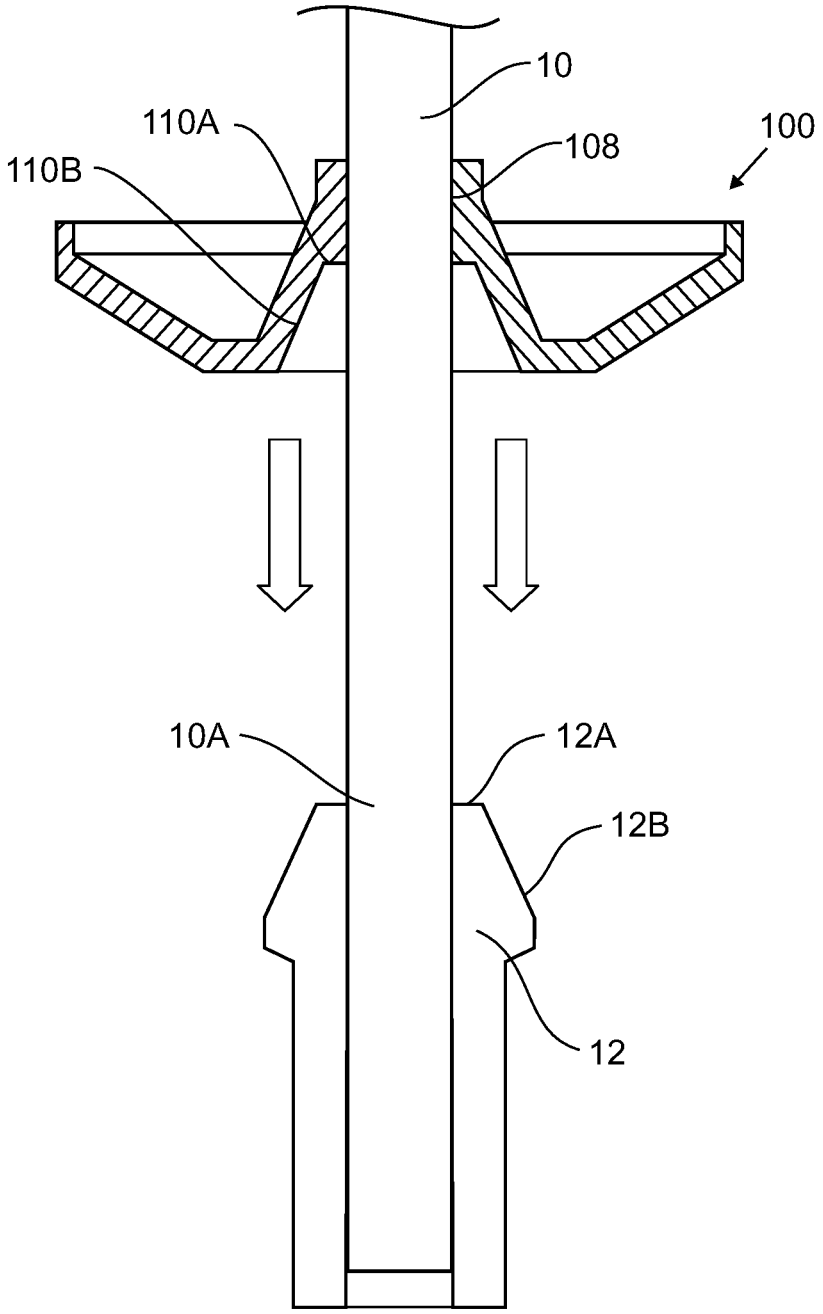
FIG. 3 is a simplified block diagram illustrating in a cross-sectional view installation of the golf ball retrieving device according to the preferred embodiment of the invention.
Figure 4:
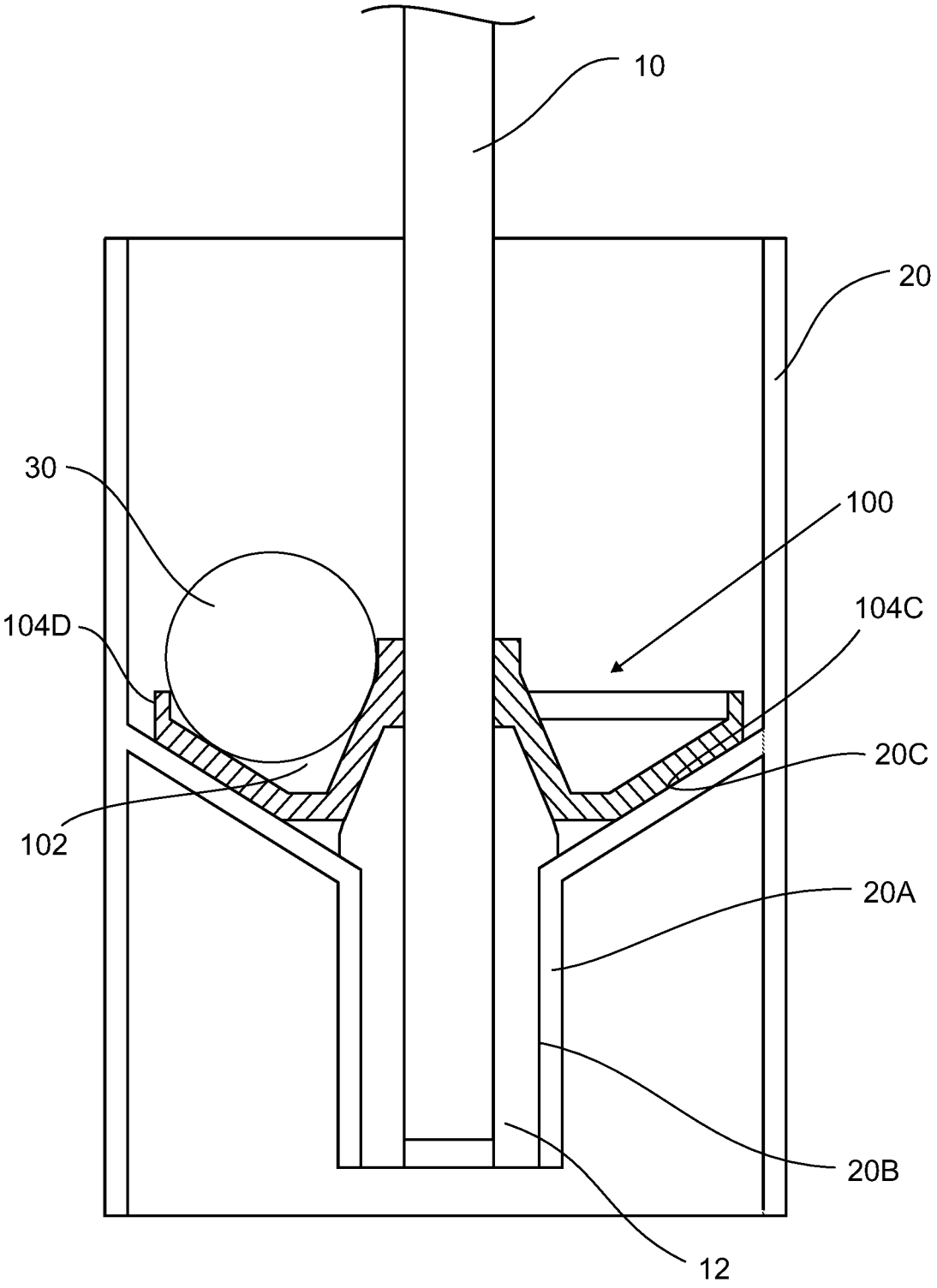
FIGS. 4 and 5 are simplified block diagrams illustrating in a cross-sectional view and a top view, respectively, the golf ball retrieving device according to the preferred embodiment of the invention, with the device being placed inside a golf cup.
Figure 5:
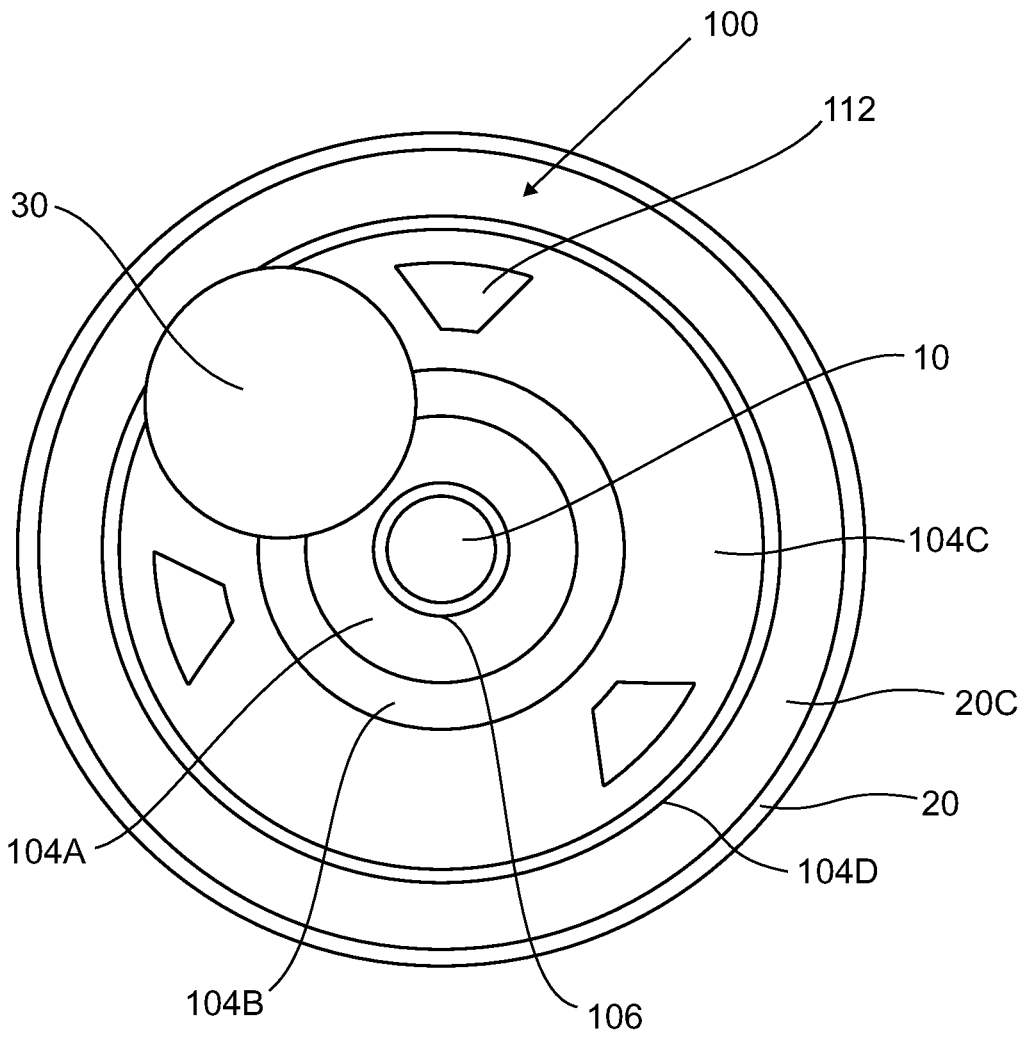

Referring to FIGS. 1 to 6 a golf ball retrieving device 100 according to a preferred embodiment of the invention is provided. The golf ball retrieving device 100 comprises a golf ball holding structure 104A-104D and an interacting structure 110A, 110B for securing the golf ball holding structure 104A-104D to the bottom portion 10A of a golf flagstick 10. In use, the golf ball holding structure 104A-104D is placed between the bottom portion 10A of the golf flagstick 10 and an inside wall of a golf cup 20 for retaining a golf ball 30 after being putted into the golf cup 20, as illustrated in FIGS. 4 and 5. Preferably, the golf ball holding structure is a trough 102 adapted for surrounding the bottom portion 10A of the golf flagstick 10. The trough 102 has an inside rim 104A for surrounding the bottom portion 10A of the golf flagstick 10 in close proximity thereto, a center portion 104B, and an outside rim 104C adapted for surrounding the bottom portion 10A of the golf flagstick 10 at a predetermined distance such that the trough 102 is capable of accommodating a bottom portion of a golf ball 30 therein. Further preferably, an outer end portion 104D of the outside rim 104C is oriented substantially vertical for securing the golf ball 30 during retrieval, as will be described hereinbelow. The outer rim 104C, 104D has an outside diameter that is sufficiently large for retaining the golf ball 30 but is also sufficiently smaller than the inside diameter of the golf cup 30 in order to facilitate insertion of the flagstick 10 with the golf ball retrieving device 100 into the golf cup 20. For example, the outside diameter of the outer rim 104C, 104D is 3.25 inch while the inside diameter of the golf cup 20 is 4 inch. The outer end portion 104D is raised, for example, ¼ inch to ½ inch.

Typically, the golf flagsticks 10 are provided with a ferrule 12 mounted to a bottom end portion of the golf flagstick 10. The ferrule 12 is adapted for being accommodated in bore 20B disposed in the base 20A of the golf cup 20 for securing the golf flagstick 10 thereto having a substantially vertical orientation. Typically, the ferrules have a top surface 12A and an angled upper side surface 12B, typically 45° to the vertical. Preferably, the interacting structure comprises interacting surfaces 110A and 110B for interacting with the top surface 12A and the angled upper side surface 12B, respectively. Further preferably, the inside rim 104A is provided with an extension 106 having bore 108 with the bore 108 having an inside diameter that is slightly larger than the outside diameter of the flagstick. For example, if the flagstick 10 has a diameter of ½ inch the diameter of the bore 108 is 9/16 inch. This allows simple installation of the golf ball retrieving device 100 by unscrewing the golf flag retaining nut at the top of the flagstick 10, inserting the flagstick 10 into the bore 108, and slidably moving the golf ball retrieving device 100 along the golf flagstick 10 until the interacting surfaces 110A and 110B are in contact with the respective surfaces 12A and 12B of the ferrule 12, as illustrated in FIGS. 3 and 4. Optionally, the diameter of the bore 108 is larger, for example ⅝ inch, in order to accommodate the larger diameter of flagsticks that have been refurbished, for example, with a vinyl covering.

Further preferably, the outside rim 104C is adapted for being supported by a portion of a top surface 20C of the base 20A of the golf cup 20. For example, the outside rim 104C is oriented substantially parallel to the portion of the angled top surface 20C—typically 45° to the vertical—of the base 20A of the golf cup 20, as illustrated in FIG. 4.

Further preferably, apertures 112 are disposed in the golf ball retrieving device 100 in order to provide water drainage and golf ball stability. For example, three apertures 112 are equidistantly disposed in the outer rim 104C with the apertures being sized to enable sufficient drainage and golf ball stability while substantially preventing leaves from passing therethrough.

Preferably, the golf ball retrieving device 100 is made of a suitable plastic material such as, for example, PolyEthylene (PE), as a single unit using a conventional plastic molding process. Alternatively, the golf ball retrieving device 100 may be made of other suitable materials such as, for example, aluminum.

Figure 6:
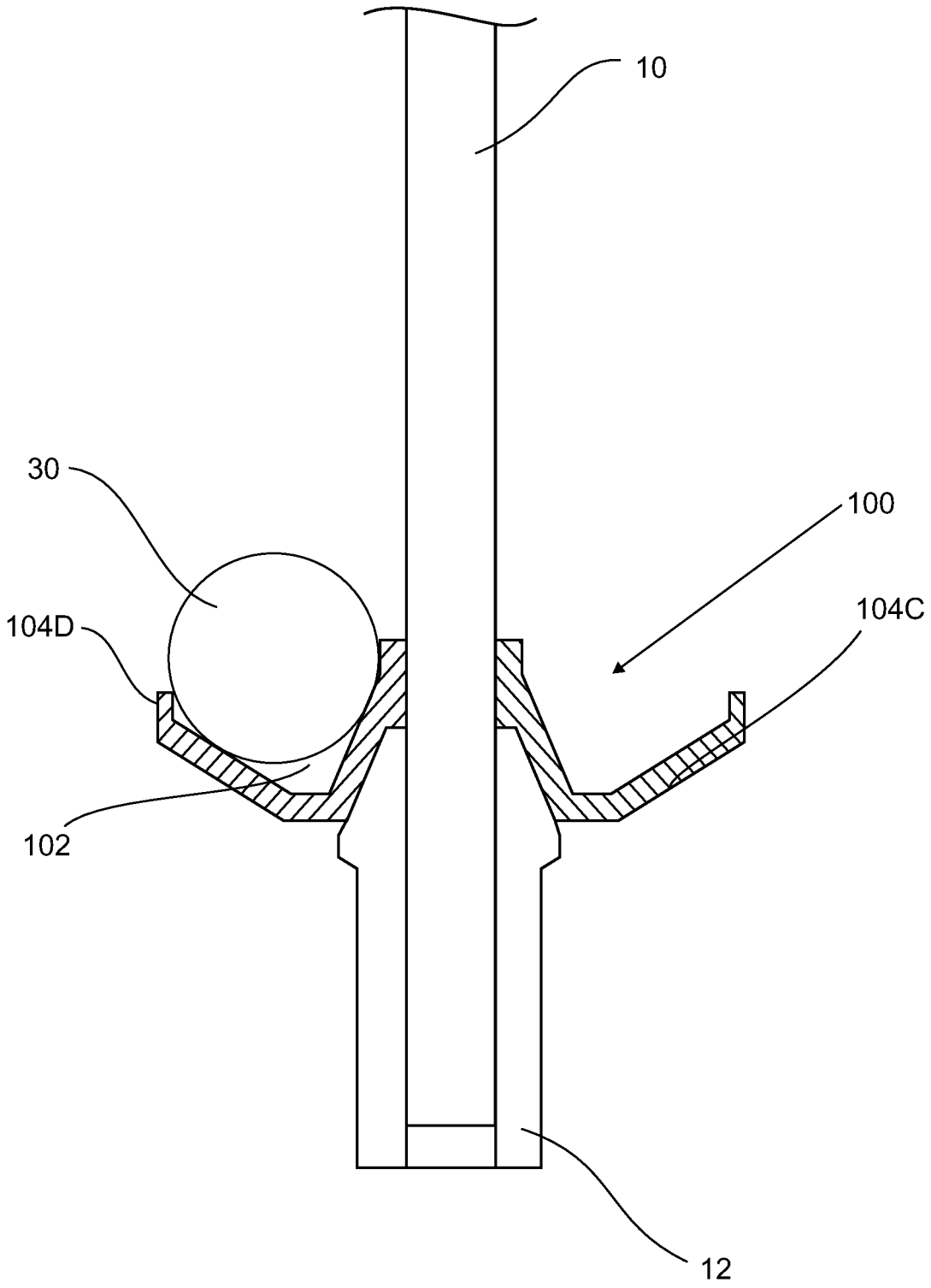
FIG. 6 is a simplified block diagram illustrating in a cross-sectional view the golf ball retrieving device according to the preferred embodiment of the invention, with the device being lifted with the golf flagstick.

In use, the golf ball retrieving device 100 is installed and secured by simply inserting the flagstick 10 into the bore 108 and sliding the same along the golf flagstick 10 until the interacting surfaces 110A and 110B are in contact with the respective surfaces 12A and 12B of the ferrule 12, as illustrated in FIG. 3. The bottom portion 10A of the flagstick 10 with the golf ball retrieving device 100 is then placed inside the golf cup 20 such that the ferrule 12 is accommodated in the bore 20B, as illustrated in FIG. 4. In order to retrieve the golf ball 30 from the golf cup 20 after putting, the golf flagstick 10 is lifted together with the golf ball retrieving device 100 upwardly from the golf cup 20, as illustrated in FIG. 6. After removal of the golf ball 30 from the golf ball retrieving device 100 the same can then be placed again into the golf cup 20. It is noted that the golf ball retrieving device 100 can hold more than one golf ball 30, typically up to three.

Optionally, one or more threaded bores, with respective screw accommodated therein, are disposed in the extension 106 and/or the inside rim 104A. The screws when abutted to the golf flagstick 10 tightly secure the golf ball retrieving device 100 to the golf flagstick 10. With the golf ball retrieving device 100 being tightly secured to the golf flagstick 10 and the same interacting with the ferrule 12 and the a portion of the top surface 20C of the base 20A of the golf cup 20, the golf ball retrieving device 100 provides substantial support to the golf flagstick 10 when the same is exposed to strong wind conditions.

Figure 7A:
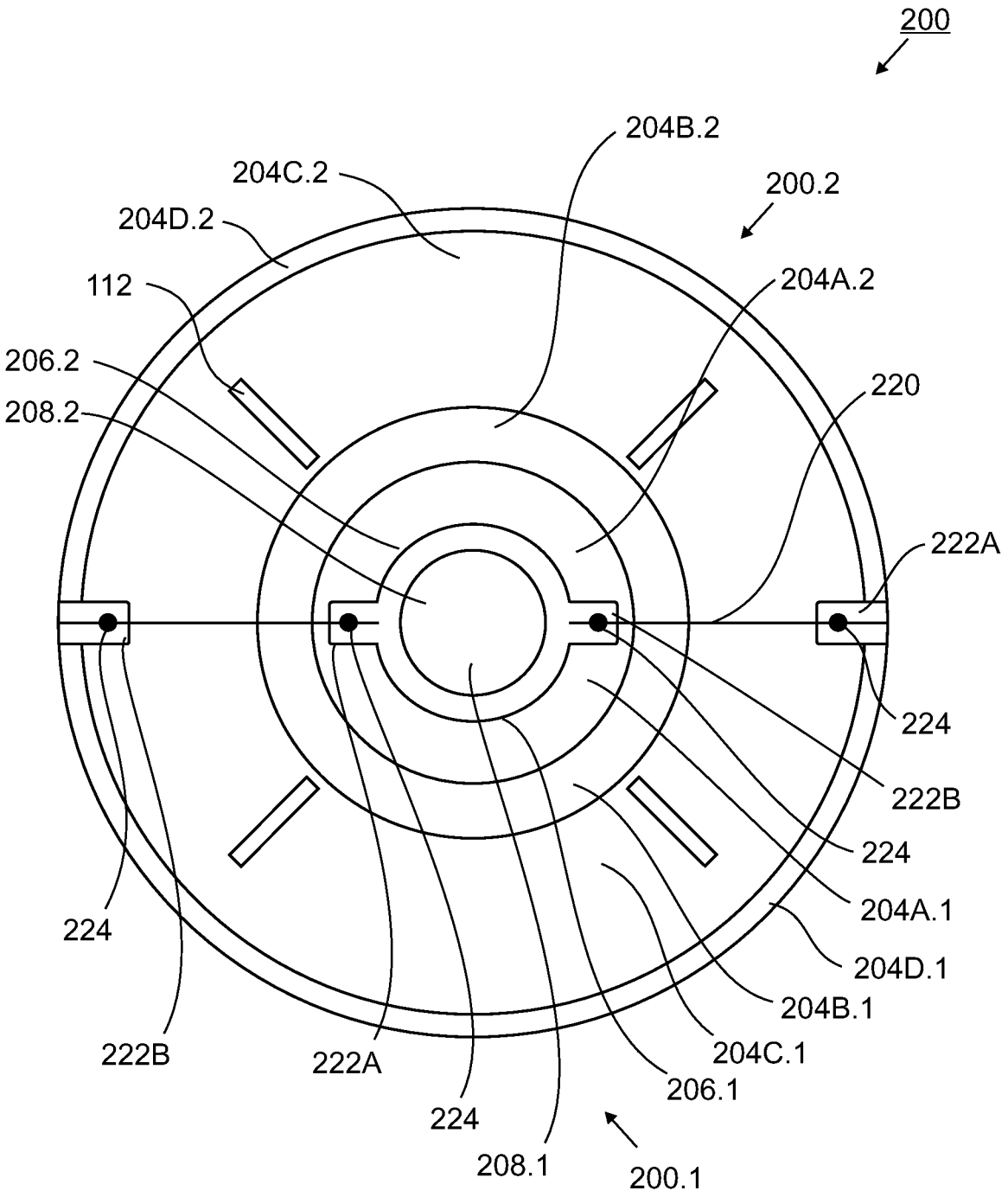
FIG. 7*a* is a simplified block diagram illustrating in a top view a golf ball retrieving device according to another preferred embodiment of the invention.
Figure 7B:
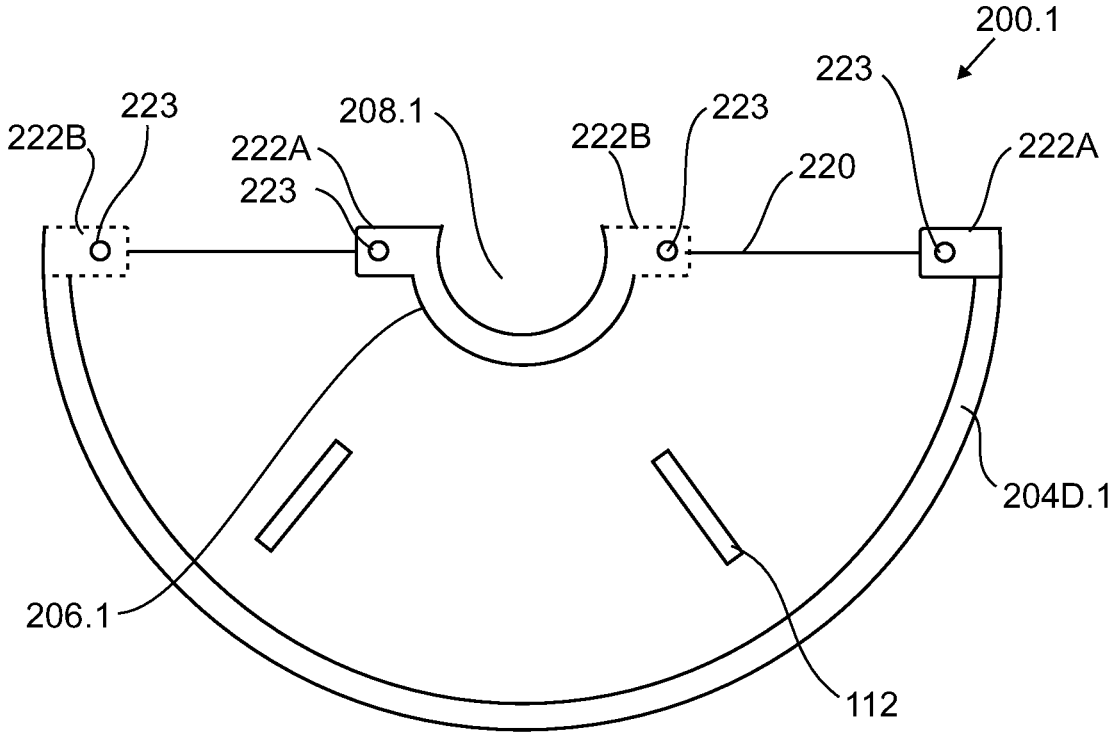
FIG. 7*b* is a simplified block diagram illustrating in a top view a half of the golf ball retrieving device according to the other preferred embodiment of the invention; and, FIG. 7*c* is a simplified block diagram illustrating in a cross-sectional view an interlocking section of the golf ball retrieving device according to the other preferred embodiment of the invention.
Figure 7C:
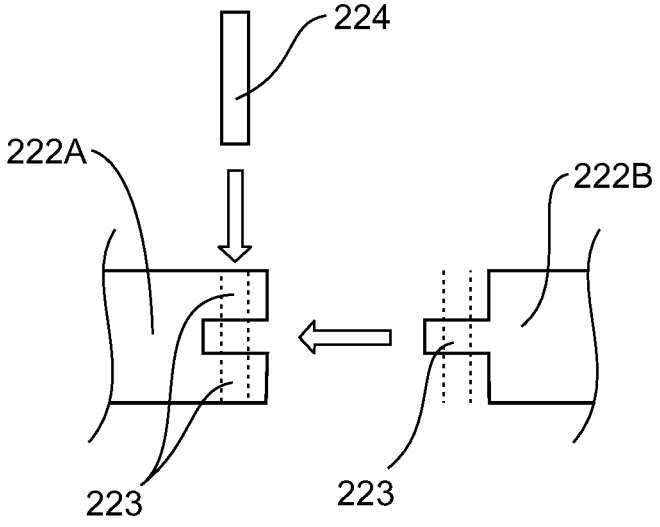

Referring to FIGS. 7*a* to 7*c* another golf ball retrieving device 200 according to a preferred embodiment of the invention is provided. Here, the golf ball retrieving device 200 comprises two halves 200.1 and 200.2 that are mated at seam 220. Preferably, the golf ball retrieving device 200 has the same shape as the golf ball retrieving device 100 with each of its components split in two halves: inside rim 204A.1, 204A.2; center portion 204B.1, 204B.2; outside rim 204C.1, 204C.2; outer end portion 204D.1, 204D.2; extension 206.1, 206.2; and bore 208.1, 208.2, as illustrated in FIG. 7*a*. Preferably, the two halves 200.1, 200.2 are designed to interlock with each other via alternate interlocking sections 222A, 222B, as illustrated in FIG. 7*b*, in order to make the same mutually interchangeable, thus substantially reducing manufacturing cost. Further preferably, the interlocking sections 222A, 222B are of tongue 222B and groove 222A design with locking pins 224 disposed in joint bores 223 for securing the same together, as illustrated in FIG. 7*c*. For example, the joint bores 223 are between 1/16 inch and 1/8 inch in diameter to accommodate respective pins 224 of a substantially same diameter therein to provide a tight fit. The pins 224 are made of a suitable plastic material such as, for example, PE. Alternatively, the pins 224 may be made of other suitable materials such as, for example, aluminum. Optionally, the interlocking sections 222A, 222B are rounded around the respective joint bore 223, for example, forming a half circle, as illustrated in FIG. 7*b*. The golf ball retrieving device 200 obviates the sliding of the same along the golf flagstick 10 and, therefore, enables provision of a bore 208.1, 208.2 that has a same diameter as the golf flagstick 10 in order to provide a tight fit between the golf ball retrieving device 200 and the golf flagstick 10 when installed. With the golf ball retrieving device 200 being tightly fitted to the golf flagstick 10 and the same interacting with the ferrule 12 and a portion of the top surface 20C of the base 20A of the golf cup 20, the golf ball retrieving device 200 provides substantial support to the golf flagstick 10 when the same is exposed to strong wind conditions.

It is noted that the golf ball retrieving device 200 can also be used in conjunction with tournament flagsticks. Tournament flagsticks comprise two portions having different diameter with the lower portion having a smaller diameter then the upper portion. The upper portion of regular tournament flagsticks has a 1 inch diameter while the lower portion has a 1/2 inch diameter. In April 2019 the USGA, along with Royal and Ancient Golf Course (R & A), published a new design for tournament flagsticks which asks for a 3/8 inch diameter of the lower portion while the diameter of the upper portion remains 1 inch to 1 1/4 inch. As is evident to one skilled in the art, the design of the golf ball retrieving device 200 is easily adapted such that the bore 208.1, 208.2 fits the different diameters—1/2 inch and 3/8 inch—of the tournament flagsticks, as well as may be adapted to fit other diameters.

As is evident to those skilled in the art, the invention is not limited to the use of tongue and groove interlocking sections for interlocking the two halves. Numerous other means for interlocking the two halves may be employed such as, for example, overlapping sections and screw fasteners or snap fastener type locking mechanisms.

Alternative embodiments may include: providing the trough 102 as a single curved structure instead of straight sections 104A, 104B, and 104C; providing only one interacting surface 110A or 110B; supporting the outside rim 104C only at a small contact area or a circular contact line; and, supporting only the outside rim 104C of the golf ball retrieving device 100 when placed inside the golf cup 20.

Further alternatively, the golf ball retrieving device 100 is provided as a substantially flat disk having a rim extending upwardly from its perimeter and a center bore for accommodating the flagstick or an upper end portion of the ferrule 12 therein.

Yet further alternatively, the golf ball retrieving device 100 is made as a lattice or wire structure, instead of a solid body, preferably, with a mesh size sufficiently small to prevent leaves from passing therethrough.

It is noted that the alternative embodiments hereinabove may also be employed in conjunction with the golf ball retrieving device 200.

The present invention has been described herein with regard to preferred embodiments. However, it will be obvious to persons skilled in the art that a number of variations and modifications can be made without departing from the scope of the invention as described herein.

What is claimed is:

1. A golf ball retrieving device comprising:

a golf ball holding structure adapted for being placed between a bottom portion of a golf flagstick and an inside wall of a golf cup, the golf ball holding structure for retaining a golf ball after being putted into the golf cup; and, an interacting structure for securing the golf ball holding structure to the bottom portion of the golf flagstick, the interacting structure comprising an interacting surface oriented downwardly and outwardly for interacting with an angled upper side surface of a ferrule mounted to the bottom portion of the golf flagstick and a bore extending upwardly from the interacting surface with the bore having a diameter slightly larger than an outside diameter of the golf flagstick.

2. The golf ball retrieving device according to claim 1 wherein the golf ball holding structure is a trough adapted for surrounding the bottom portion of the golf flagstick, the trough having an inside rim for surrounding the bottom portion of the golf flagstick in close proximity thereto and an outside rim adapted for surrounding the bottom portion of the golf flagstick at a predetermined distance such that the trough is capable of accommodating a bottom portion of a golf ball therein.

3. The golf ball retrieving device according to claim 2 wherein the outside rim is adapted for interacting with a portion of a top surface of a base of a golf cup.

4. The golf ball retrieving device according to claim 3 wherein a substantial portion of the outside rim is oriented substantially parallel to the portion of the top surface of the base of the golf cup.

5. The golf ball retrieving device according to claim 2 wherein an outer end portion of the outside rim is oriented substantially vertical.

6. The golf ball retrieving device according to claim 2 wherein the inside rim is extended upwardly and has the bore disposed therein.

7. The golf ball retrieving device according to claim 2 comprising at least an aperture disposed in the trough.

8. The golf ball retrieving device according to claim 2 wherein the bore has a length that is substantially larger than a wall thickness of the inside rim.

9. The golf ball retrieving device according to claim 1 wherein the interacting structure comprises a second interacting surface oriented substantially horizontal for interacting with a top surface of the ferrule.

10. The golf ball retrieving device according to claim 1 wherein the golf ball holding structure comprises two interlocked halves.

11. A method for retrieving a golf ball from a golf cup comprising:

providing a golf ball retrieving device according to claim 1;

providing a golf flagstick having a ferrule mounted to a bottom portion thereof;

inserting a top end of the golf flag stick into the bore;

sliding the golf ball retrieving device along the golf flagstick until the interacting surface is in contact with same is in contact with the upper side surface of the ferrule;

placing the ferrule with the golf ball retrieving device into a respective bore of a golf cup;

putting a golf ball into the golf cup;

lifting the golf flagstick with the golf ball retrieving device upwardly from the golf cup; and, removing the golf ball from the golf ball retrieving device.

12. The golf ball retrieving device according to claim 1 wherein the bore has a diameter that is 1/16 inch to 1/8 inch larger than the outside diameter of the golf flagstick.

* * * * *